US005858107A

United States Patent [19]

Chao et al.

[11] Patent Number: 5,858,107

[45] Date of Patent: Jan. 12, 1999

[54] LIQUID CARBON DIOXIDE CLEANING USING JET EDGE SONIC WHISTLES AT LOW TEMPERATURE

[75] Inventors: Sidney C. Chao, Manhattan Beach; Edna M. Purer, Los Angeles; Nelson W. Sorbo, Redondo Beach, all of Calif.

[73] Assignee: Raytheon Company, El Segundo, Calif.

[21] Appl. No.: 3,913

[22] Filed: Jan. 7, 1998

[51] Int. Cl.[6] ..... B08B 5/02

[52] U.S. Cl. ..... 134/1; 134/1.3; 134/2; 134/10; 134/13; 134/32; 134/34; 134/35; 134/40; 134/198; 134/199; 134/200; 134/902; 210/748

[58] Field of Search ..... 134/1, 1.3, 2, 10, 134/13, 32, 34, 35, 40, 198, 199, 200, 902; 210/748

[56] References Cited

U.S. PATENT DOCUMENTS 5,013,366 5/1991 Jackson et al. ..... 134/1
5,213,619 5/1993 Jackson et al. ..... 134/1
5,316,591 5/1994 Chao et al. ..... 134/34
5,339,844 8/1994 Stanford, Jr. et al. ..... 134/107
5,370,740 12/1994 Chao et al. ..... 134/1
5,456,759 10/1995 Stanford, Jr. et al. ..... 134/1
5,467,492 11/1995 Chao et al. ..... 8/159
5,651,276 7/1997 Purer et al. ..... 68/5 C

*Primary Examiner*—Lyle A. Alexander
*Assistant Examiner*—S. Carrillo
*Attorney, Agent, or Firm*—Colin M. Raufer; Leonard A. Alkov; Glenn H. Lenzen, Jr.

[57] ABSTRACT

A cleaning system and method utilizing sonic whistle agitation to enhance the soil removal and mass transport capacity of the liquid carbon dioxide at low process temperatures. Sonic whistles are within a cleaning chamber, and liquid carbon dioxide is forced out of the sonic whistle jets to ultrasonically emulsify and disperse non-miscible liquids or insoluble solids, such as remove low solubility oils and greases, in the liquid carbon dioxide contained in the cleaning chamber. Cleaning is accomplished at temperatures between −68° F. and 88° F., and the temperature of the liquid carbon dioxide is typically below 32° F.

6 Claims, 3 Drawing Sheets

LIQUID CARBON DIOXIDE CLEANING USING JET EDGE SONIC WHISTLES AT LOW TEMPERATURE

BACKGROUND

The present invention relates generally to liquid carbon dioxide cleaning systems and methods, and more particularly, to the use of jet edge sonic generators to ultrasonically emulsify and disperse non-miscible liquids in liquid carbon dioxide solvent.

All cleaning and degreasing solvents currently used present health risks and are environmentally detrimental. For example, perchloroethylene is a suspected carcinogen, petroleum based solvents are flammable and smog producing, 1, 1, 1-trichloro-ethylene is known to deplete the earth's ozone layer and is scheduled for phase-out.

Liquid carbon dioxide is an inexpensive and unlimited natural resource, that is non-toxic, non-flammable, non-smog-producing or ozone-depleting. Liquid carbon dioxide does not damage fabrics, or dissolve common dyes, and exhibits solvating properties typical of hydrocarbon solvents. Its properties make it a good dry cleaning medium for fabrics and garments and industrial rags, as well as a good degreasing solvent for the removal of common oils and greases used in industrial processes.

One disadvantage of the liquid carbon dioxide as a degreasing solvent is its reduced solvating capability compared to the common degreasing solvents. This deficiency has usually been addressed by the use of chemical additives or co-solvents. These additives increase the cost of operation and must be separated out for disposal, as part of solvent reclamation processing, further increasing operating costs.

Accordingly, it is an objective of the present invention to provide for a liquid carbon dioxide cleaning system and method that uses jet edge sonic generators to ultrasonically emulsify and disperse non-miscible liquids in liquid carbon dioxide solvent.

SUMMARY OF THE INVENTION

To accomplish the above and other objectives, the present invention provides for an improved liquid carbon dioxide cleaning method that comprises jet edge sonic generators as a means of ultrasonically emulsifying and dispersing non-miscible liquids in liquid carbon dioxide used in the cleaning system.

The use of the jet edge sonic generators may be used along with other cleaning techniques and the cleaning process can be performed at a low processing temperatures. Typically, cleaning is performed at temperatures between −68° F. and 88° F. The present invention is particularly relevant to processes that utilize liquid carbon dioxide as a degreasing or cleaning solvent.

The present invention reduces the cost of the liquid carbon dioxide degreasing system and process described in U.S. Pat. Nos. 5,339,844 and 5,316,591, respectively, which are assigned to the assignee of the present invention. These savings are due to cost reductions through the physically enhanced transport capacity of the liquid carbon dioxide.

The present invention addresses the replacement of conventional cleaning fluids with liquid carbon dioxide. It also addresses liquid carbon dioxide degreasing of common machined parts. The present invention improves the mass transport potential of the liquid carbon dioxide by sono-hydrodynamic agitation, minimizing the need for solvent enhancing additives.

Because of the enhanced cleaning capabilities of sono-hydrodynamic agitation, effective cleaning is carried out in a low temperature environment, with liquid carbon dioxide temperatures below 32° F. (0° C.). Because the operating temperature of the present cleaning system is lower than that described previously, the system operating pressure is lower. This lower pressure results in more economical system manufacturing and operation, while maintaining a cleaning level achieved at higher liquid carbon dioxide temperatures and associated higher pressures.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1A:
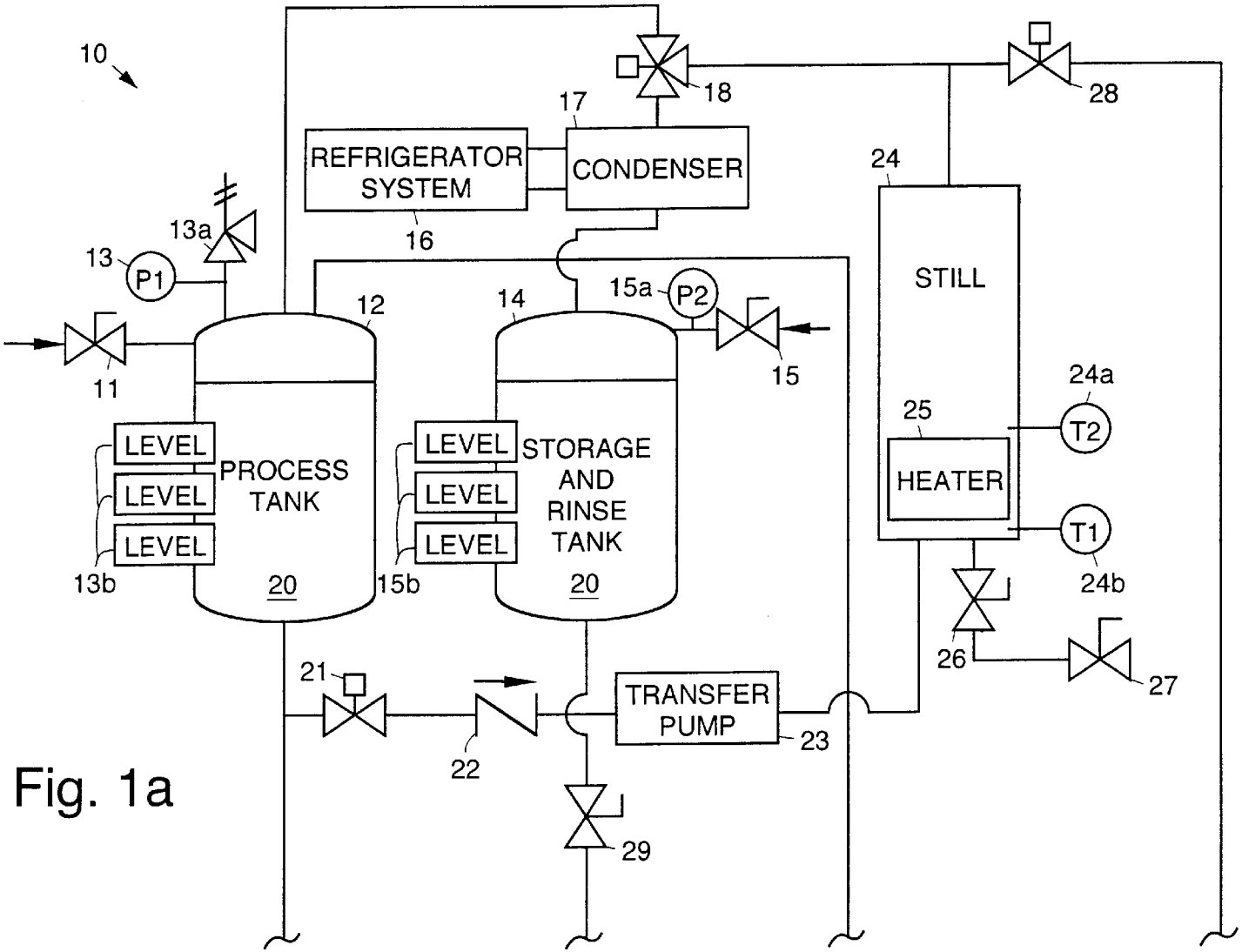
FIGS. 1*a* and 1*b* illustrate a liquid carbon dioxide cleaning system embodying a cleaning method in accordance with the principles of the present invention.
Figure 1B:
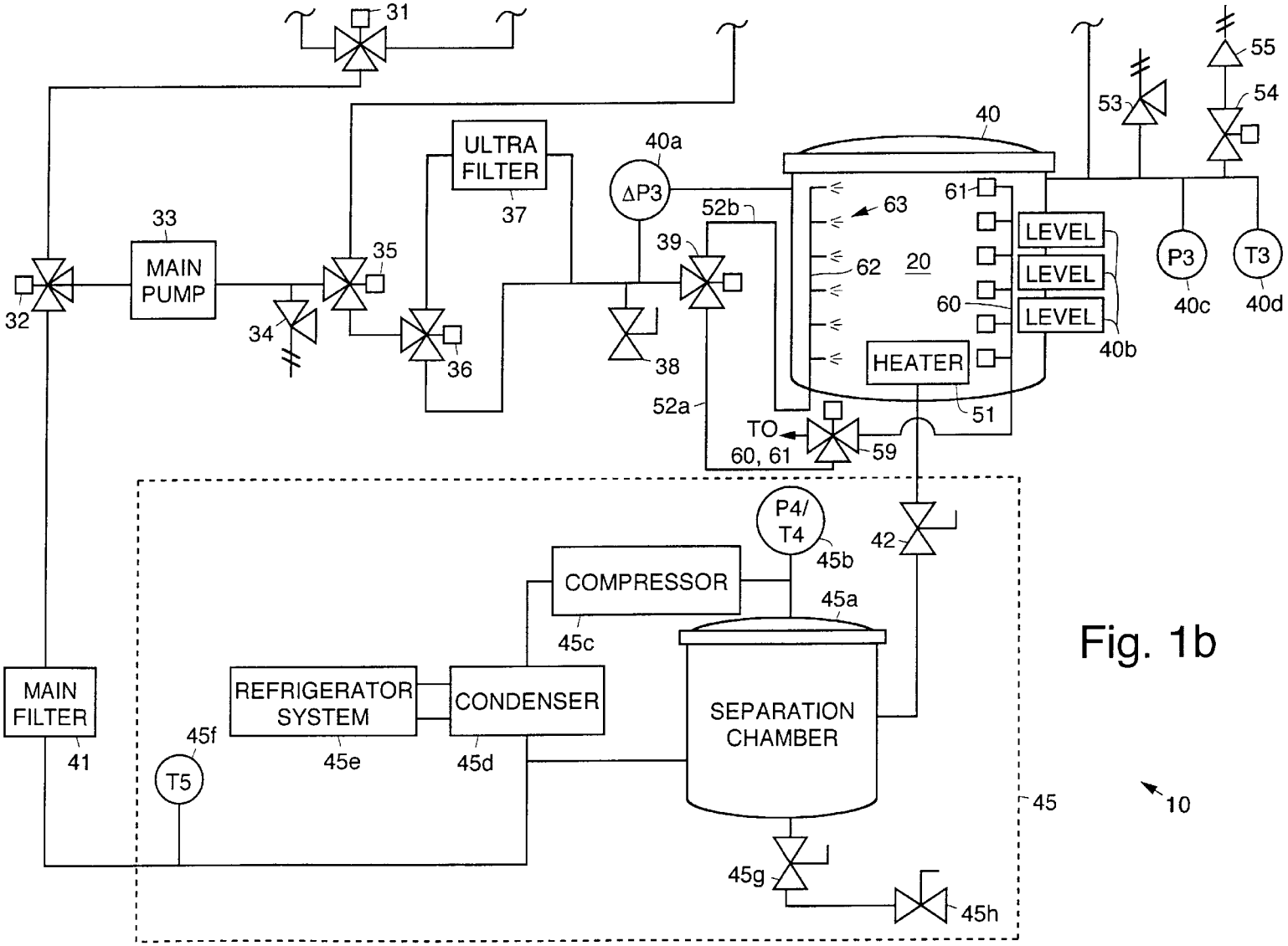

Referring to the drawing figures, FIGS. 1*a* and 1*b* illustrate a liquid carbon dioxide cleaning system 10 embodying a cleaning method in accordance with the principles of the present invention. Referring to FIG. 1*a,* the liquid carbon dioxide cleaning system 10 comprises a process tank fill valve 11 that is coupled to a process tank 12 and that is used to fill the process tank 12 with liquid carbon dioxide 20. A pressure gauge 13 (P1) and pressure relief valve 13*a* are coupled to the process tank 12. Level sensors 13*b* for the process tank 12 are used to monitor the level of liquid carbon dioxide 20 in the process tank 12.

A storage and rinse tank 14 is provided that has a storage tank fill valve 15 and storage tank pressure gauge 15*a* (P2) coupled thereto that are used to fill the storage and rinse tank 14 with liquid carbon dioxide 20. Level sensors 15*b* are used to monitor the level of liquid carbon dioxide 20 in the storage and rinse tank 14.

An output line of the process tank 12 is coupled by way of a first valve 21 and a check valve 22 to a transfer pump 23 whose output is coupled to a still 24 having an internal heater 25. The still 24 has first and second temperature gauges 24*a,* 24*b* (T1, T2) coupled thereto, above and below the heater 25. An output of the still 24 is coupled to an input of a first three-way valve 18. A second output of the still 24 is coupled through two manual check valves 26, 27 that are used to drain the still 24.

A first output of the first three-way valve 18 is coupled to the process tank 12 and is used to pressurize the process tank 12 from the still 26. A second output of the first three-way valve 18 is coupled through a condenser 17 which has a refrigerator system 16 coupled thereto. The output of the condenser 17 is coupled to the storage and rinse tank 14. The output of the storage and rinse tank 14 is coupled to a valve 29.

Referring to FIG. 1*b,* the output of the process tank 12 is coupled to a main pump 33 through second and third three-way valves 31, 32. The output of the storage and rinse tank 14 is also coupled to the main pump 33 through the second and third three-way valves 31, 32. The main pump 33 is connected to either the process tank 12 or the cleaning chamber 40 by way of a fourth three-way valve 35. A pressure relief valve 34 is located downstream of the main pump 33. A fifth three-way valve 36 is located between fourth three-way valve 35 and a cleaning chamber 40 and flow of liquid carbon dioxide 20 from the process tank 12 to the cleaning chamber 40 is sent through an ultra-filter 37 to the cleaning chamber 40.

Figure 3:
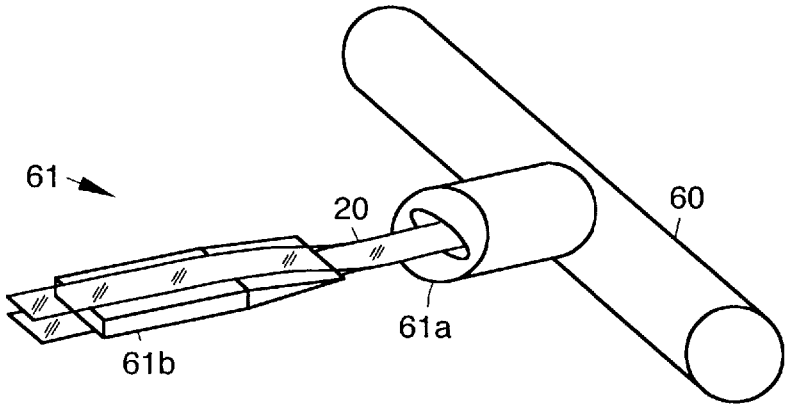
FIG. 3 illustrates details of jet edge sonic generators used in the present invention.

Flow of liquid carbon dioxide 20 to the cleaning chamber 40 is directed through a sixth three-way valve 39, to either a sonic whistle manifold feed pipe 52*a* or a spray nozzle feed pipe 52*b*. The sonic whistle manifold feed pipe 52*a* feeds a seventh three-way valve 59, which in turn feeds a plurality of sonic whistle manifolds 60 located within the cleaning chamber 40, each containing a plurality of sonic whistles 61 that comprise an elliptical nozzle 61*a* and blade 61*b*, as shown in FIG. 3. The sonic whistles 61 are located in a variety of locations and at various angles within the cleaning chamber 40.

The spray nozzle feed pipe 52*b* feeds a plurality of spray nozzle manifolds 62 in cleaning chamber 40, each comprising a plurality of spray nozzles 63 located at various locations and at various angles within the cleaning chamber 40. Use of the spray nozzles 63 provide a means of rinsing and flushing parts in the cleaning chamber 40. The cleaning chamber 40 also includes a heater 51 that is used to heat the parts during depressurization step of the cleaning process.

The pressure differential across the sonic whistles 61 and spray nozzles 63 is monitored with a differential pressure sensor 40*a*. The level of the liquid carbon dioxide 20 in the cleaning chamber 40 is monitored by a plurality of level sensors 40*b* located at various locations throughout the cleaning chamber 40. The temperature and pressure in the cleaning chamber 40 are monitored with a pressure sensor 40*c* and temperature sensor 40*d*. The cleaning chamber 40 is equipped with a pressure relief valve 53. Venting of residual gaseous carbon dioxide 20 remaining in the cleaning chamber 40 after cleaning and rinsing is accomplished through a vent control valve 54 and a vent 55. Gas head connections between the cleaning chamber 40 and the still 24, storage and rinse tank 14, and process tank 12 are made through a gas head valve 28 shown in FIG. 1*a*.

The liquid carbon dioxide 20 exits the cleaning chamber 40 and is conveyed to an on-line separation system 45 through a manual valve 42. The on-line separation system 45 comprises the separation chamber 45*a*, a compressor 45*c*, a condenser 45*d*, and a refrigeration system 45*e*. Temperature and pressure in the separation chamber 45*a* are monitored by a sensor 45*b*. The temperature of the liquid leaving the on-line separation system 45 is monitored by a temperature sensor 45*f*. Manual valves 45*g*, 45*h* permit the removal of residue collected in the separation chamber 45*a* without its depressurization. Liquid carbon dioxide 20 leaving the on-line separation system 45 passes through a main filter 41 and to third three-way valve 32.

Figure 2:
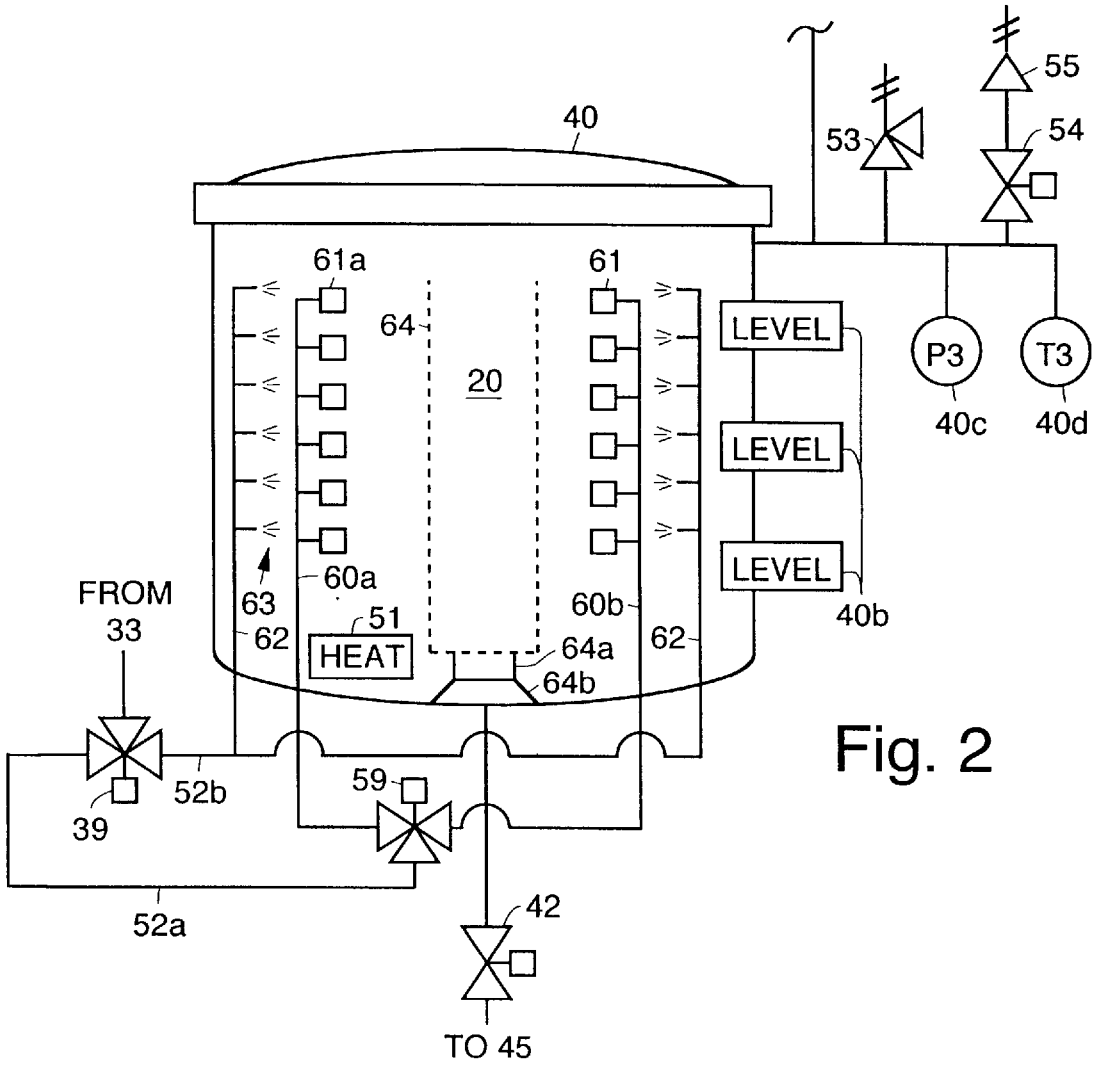
FIG. 2 illustrates a cleaning chamber employing sonolating nozzle manifolds configuration used in the system of FIG. 1.

FIG. 2 illustrates details of the cleaning chamber 40 wherein sonic whistle manifolds 60 fed by the sonic whistle feed pipe 52*a* via the seventh three-way valve 59, and spray nozzle manifolds 62 fed by the spray nozzle feed pipe 52*b*. The seventh three-way valve 59 is used to rapidly switch between two different banks of sonic whistle manifolds 60*a*, 60*b*. The plurality of sonic whistle manifolds 60 feed a plurality of sonic whistles 61 located at various level and angles within the cleaning chamber 40. The sonic whistles 61 comprise an elliptical orifice 61*a* and a blade 61*b* as is shown in FIG. 3. The plurality of sonic whistles 61 are supplied with high pressure liquid carbon dioxide 20 from the main pump 33 through the cleaning chamber valve 39.

Alternatively, liquid carbon dioxide 20 may be sprayed into the cleaning chamber 40 by way of the feed pipe 52*b* which feeds the plurality of spray nozzle manifolds 62 in the cleaning chamber 40, each having a plurality of spray nozzles 63 located at various locations and at various angles within the cleaning chamber 40. Use of the spray nozzles 63 provide a means of rinsing and flushing parts in the cleaning chamber 40.

FIG. 2 also shows a parts basket 64 equipped with a swivel bearing 64*a* and a parts basket mount 64*b*. The parts basket 64 is used to hold or provide a surface on which to mount the parts to be cleaned. The swivel bearing 64*a* permits rotation of the basket 64 due to convective force of liquid carbon dioxide 20 striking the parts basket 64 from either the sonic whistles 61 or the spray nozzles 63, or it may be adjusted to maintain its location, independent of movement of the liquid carbon dioxide 20 within the cleaning chamber 40. The cleaning chamber heater 51 is also depicted in FIG. 2 and provides a means of heating the parts in the cleaning chamber 40 without impeding the movement of the liquid carbon dioxide 20 or the parts basket 64. For completeness FIG. 2 also shows the pressure relief valve 53, the vent control valve 54 and the vent 55, as well as the gas head connections between the cleaning chamber 40 and the still 24, storage and rinse tank 14, and process tank 12 through the gas head valve 28.

Referring to FIG. 3, the present invention addresses the use of sono-hydrodynamic agitation produced by the sonolating nozzle manifolds 52 and the sonic whistles 61 as a means of enhancing the mass transport and solvating potential of the liquid carbon dioxide 20. The sonic whistle manifolds 52*a* couple liquid carbon dioxide 20 to the plurality of elliptical orifices 61 a through which the liquid carbon dioxide 20 is forced. The liquid carbon dioxide 20 subsequently passes over the plurality of edges or blades 61*b*. If non-miscible liquids such as oil and water are subjected to intense mechanical agitation, an emulsion or colloid solution is formed as a result of the forces acting at the interface between the two liquids. The sonic whistles 61 ultrasonically emulsify and disperse non-miscible liquids in the liquid carbon dioxide 20 used in the cleaning system 10. Thus, surfaces containing oil or grease may be more easily cleaned using the present cleaning method, as embodied in the exemplary system 10.

Emulsification or dispersion of non-miscible oils and greases is necessary to remove them off parts at low temperatures, using liquid carbon dioxide 20 as a cleaning medium. Certain conditions must be fulfilled before a stable emulsion can be formed. The insoluble component must be broken down into small enough particles in order to form the emulsion. The extent of dispersion increases with the decrease in the viscosity of the medium. When one liquid is dispersed in another to form an emulsion, the rate of settling of the suspended particles is directly proportional to the difference in density compared to the surrounding liquid, and to the square of the diameter of the particles. Theoretical energy requirements are high for high pressure mechanical homogenizers. Typically homogenizers require 40–50 horsepower when processing 1000 gal/hour.

Sonic whistles 61 have been used for ultrasonic emulsification and dispersion. The sonic whistles 61 cause vortices to be formed as a fluid flows through the orifice 61*a* and achieves a measure of stabilization by hydrodynamic feed-back between a jet and an edge or blade 61*b*. Sonic radiation can accomplish an equivalent amount of emulsification using only 7 horsepower.

Operation of the sonic whistle 61 is as follows. Liquid carbon dioxide 20 under high pressure is forced through the elliptical orifice 61*a* across the blade 61*b*. The resultant jet of high velocity (approximately 300 feet/second) fluid impinges on the thin blade 61*b* which results in the development of and subsequent shedding of vortices perpendicular to the direction of fluid flow. The vortex shedding creates a steady oscillation of the blade 61*b* in the ultrasonic frequency range. As the fluid tries to fill the minute void space created on either side of the blade 61*b* as it oscillates, zones of intense cavitation are generated. It is the extremely high level of shear force resulting from the collapse of cavitation bubbles that shatters fluids and causes the desired dispersion effects.

The frequency of oscillation is dependent on the free stream flow velocity and the thickness of the blade 61*b*, and to a lesser degree, the Reynolds number of the flow. The flow rate through the nozzle orifice is a simple function of the pressure drop across the nozzle and the fluid density (flow velocity≦(2*Pressure drop/density). Thus for flow velocities necessary to cause ultrasonic agitation, the pressure drop across the sonic whistle 61 is on the order of 700 psi.

The cavitation bubbles generated by the sonic whistle 61 can serve to remove particulate or solid matter off part surfaces, in a manner similar to that commonly observed with ultrasonic generators using piezoelectric crystals, or other means of generating cavitation bubbles. In addition to generating cavitation bubbles in the ultrasonic frequency range, the flow stream has kinetic energy that can be utilized to remove particulate matter and other insoluble materials from the parts. The use of the fluid kinetic energy, also called hydrodynamic agitation, is disclosed in U.S. Pat. No. 5,456,759 entitled "Dry Cleaning of Garments using Liquid Carbon Dioxide under Agitation as Cleaning Medium". In the present invention, the sonic whistle 61 are strategically placed in the chamber to deliver hydrodynamic agitation necessary to remove particulate matter from the surface of parts, generate cavitation bubbles in the ultrasonic frequency range to emulsify insoluble materials already entrained in the fluid, direct the flow stream of cavitating bubbles to surfaces to be cleaned where they collapse, creating intense turbulence and heat, which results in the cleaning of the part, and to circulate bulk fluid around the chamber 40.

The exemplary system 10 also takes advantage of reversible agitation to enhance the turbulence and thus improve mixing, emulsification, and cleaning. The reversible agitation feature of the system 10 occurs as the result generating a vortex of fluid in the chamber 40 using one bank of sonic whistle manifolds 60*b*, and then using the fast switching three-way cleaning chamber valve 59, a second bank of sonic whistle manifolds 60*b* generate a vortex of fluid in the opposite direction. Specific locations of the sonic whistles 61 are staggered vertically so that large volumes of the cleaning chamber 40 are cleaned. The result is intense mixing, turbulence and enhanced cleaning.

Because the use of sonic whistles 61 mechanically enhances the mass transport capability of liquid carbon dioxide 20, the system 10 is capable of effective cleaning at temperatures below 32° F. (0° C.), typically, between −68° F. and 88° F. Operation of the system 10 at low temperatures results in corresponding system pressures that are much lower than the typical operating pressures previously used, ranging from 550 to 800 psi (3.79 to 5.52 Mpa). In the present low temperature cleaning system 10, effective cleaning can occur at temperatures of 0° F. (−16° C.). This corresponds to a system pressure of about 300 psia (2.11 MPa). At this value, the pressure rating of this system 10 is dramatically lowered, and simplified, as this pressure is typically the same as that of standard carbon dioxide dewars, which is utilized worldwide. The exemplary low pressure cleaning system 10 that embodies the present method thus provides for significant system 10, and capital cost savings.

Removal of compounds emulsified by the sonic whistles 61 from the medium 20 occurres by directing the flow of liquid carbon dioxide 20 to the separator 45 which utilizes a low flow condition and lower temperature to encourage agglomeration/coalescence and subsequent separation of these compounds from the liquid carbon dioxide 20. At the low liquid carbon dioxide temperatures described above, agglomeration and coagulation of greases and oils is greatly accelerated.

Using the sono-hydrodynamic agitation generated by the sonic whistles 61, the parts are cleaned and much of the oil and grease are carried away by the liquid carbon dioxide 20 to the on-line separation chamber 45. After the cleaning process is complete, the cleaning chamber 40 is drained by changing the direction of the fourth three-way valve 35 to deliver liquid carbon dioxide 20 back to the process tank 12. To rinse the parts, the second three-way valve 31 is adjusted to draw clean liquid carbon dioxide from storage and rinse tank 14, the fourth three-way valve 35 is readjusted to direct clean carbon dioxide to the cleaning chamber 40 while the cleaning chamber valve 39 is adjusted to deliver clean carbon dioxide 20 to the banks of spray nozzle manifolds 62. A clean high pressure spray of liquid carbon dioxide 20 is delivered through the spray nozzles 63 to the parts in the parts basket 64.

The present method, as embodied in the exemplary system 10 may be used to degrease common machined parts using liquid carbon dioxide 20. The present invention improves the soil removal and mass transport ability of the liquid carbon dioxide 20 by sono-hydrodynamic agitation, minimizing the need for solvent enhancing additives.

Because of the enhanced cleaning capabilities of sono-hydrodynamic agitation provided by the sonic whistles 61, effective cleaning is carried out in a low temperature environment, with liquid carbon dioxide temperatures below 32° F. (0° C.). Because the operating temperature of the present cleaning system 10 and method is lower than that of prior systems and methods, the operating pressure of the system 10 is lower. This lower pressure results in more economical system manufacturing and operation, while maintaining a cleaning level achieved at higher liquid carbon dioxide temperatures and associated higher pressures.

Thus, an improved liquid carbon dioxide cleaning system that uses jet edge sonic whistles to remove and ultrasonically emulsify and disperse non-miscible liquids or solids in liquid carbon dioxide solvent has been disclosed. It is to be understood that the described embodiment is merely illustrative of some of the many specific embodiments that represent applications of the principles of the present invention. Clearly, numerous and other arrangements can be readily devised by those skilled in the art without departing from the scope of the invention.

What is claimed is:

1. In a liquid carbon dioxide cleaning system having a cleaning chamber, a storage tank containing liquid carbon dioxide, a pump for pumping the liquid carbon dioxide from the storage tank to the cleaning chamber, a gas recovery compressor communicating with said cleaning chamber for compressing gaseous carbon dioxide into the liquid carbon dioxide, a condenser communicating with said gas recovery compressor for recondensing the gaseous carbon dioxide, and a still communicating with said cleaning chamber and containing a heater for heating the liquid carbon dioxide, a method for removing immiscible liquids or insoluble solids from parts disposed in the cleaning chamber, the method comprising the steps of:

a) disposing sonic whistles within the cleaning chamber;

b) pumping liquid carbon dioxide from the storage tank into the cleaning chamber through said sonic whistles; and c) forcing said liquid carbon dioxide out of said sonic whistles to remove said immiscible liquids or said insoluble solids from said parts and to ultrasonically emulsify said immiscible liquids or said insoluble solids in the liquid carbon dioxide in said cleaning chamber, thereby cleaning said parts disposed in said cleaning chamber.

2. The method of claim 1 wherein cleaning of said parts is performed at temperatures between −68° F. and 88° F.

3. The method of claim 1 wherein said liquid carbon dioxide used for cleaning said parts in said cleaning chamber has a temperature of less than 32° F.

4. In a liquid carbon dioxide cleaning system having a cleaning chamber, a storage tank containing liquid carbon dioxide, a pump for pumping the liquid carbon dioxide from the storage tank to the cleaning chamber, a gas recovery compressor communicating with said cleaning chamber for compressing gaseous carbon dioxide into the liquid carbon dioxide, a condenser communicating with said gas recovery compressor for recondensing the gaseous carbon dioxide, and a still communicating with said cleaning chamber and containing a heater for heating the liquid carbon dioxide, a method for removing greases and oils from parts disposed in the cleaning chamber, the method comprising the steps of:

a) disposing sonic whistles within the cleaning chamber;

b) pumping liquid carbon dioxide from the storage tank into the cleaning chamber through said sonic whistles;

c) forcing said liquid carbon dioxide out of said sonic whistles to remove said greases and said oils from said parts and to ultrasonically emulsify said greases and said oils in the liquid carbon dioxide in said cleaning chamber, thereby cleaning said parts disposed in said cleaning chamber; and d) transporting said liquid carbon dioxide containing the emulsified greases and oils out of said cleaning chamber.

5. The method of claim 4 wherein cleaning of said parts is performed at temperatures between −68° F. and 88° F.

6. The method of claim 4 wherein said liquid carbon dioxide used for cleaning said parts in said cleaning chamber has a temperature of less than 32° F.

* * * * *